US009745779B2

(12) United States Patent
Go et al.

(10) Patent No.: US 9,745,779 B2
(45) Date of Patent: Aug. 29, 2017

(54) AUTOMATED TELLER MACHINE WITH AN AUTOMATICALLY ACTUATABLE LOCKING ELEMENT FOR LOCKING CASH BOXES RECEIVED IN RECEIVING COMPARTMENTS IN THESE RECEIVING COMPARTMENTS

(71) Applicant: Wincor Nixdorf International GmbH, Paderborn (DE)

(72) Inventors: Florante Go, Singapore (SG); Ronald Hidalgo, Singapore (SG)

(73) Assignee: WINCOR NIXDORF INTERNATIONAL GMBH, Paderborn (DE)

( * ) Notice: Subject to any disclaimer, the term of this patent is extended or adjusted under 35 U.S.C. 154(b) by 0 days.

(21) Appl. No.: 15/157,433

(22) Filed: May 18, 2016

(65) Prior Publication Data

US 2016/0340933 A1 Nov. 24, 2016

(30) Foreign Application Priority Data

May 19, 2015 (EP) ..... 15168190

(51) Int. Cl.
*G07F 9/10* (2006.01)
*E05B 65/46* (2017.01)
(Continued)

(52) U.S. Cl.
CPC ..... *E05B 65/461* (2013.01); *A47B 88/467* (2017.01); *G07D 11/0006* (2013.01);
(Continued)

(58) Field of Classification Search
CPC ..... E05B 57/00; E05B 65/08; E05B 65/0811; E05B 65/0817; E05B 65/46;
(Continued)

(56) References Cited

U.S. PATENT DOCUMENTS 6,047,998 A 4/2000 Pollard et al.
8,438,885 B2 * 5/2013 Calder ..... E05B 47/0603 109/47
(Continued)

FOREIGN PATENT DOCUMENTS

GB 231239 B * 3/1925
GB 1 117 071 6/1968
(Continued)

OTHER PUBLICATIONS

European Search Report of Dec. 3, 2015.

*Primary Examiner* — Mark Beauchaine
(74) *Attorney, Agent, or Firm* — Gerald E. Hespos; Michael J. Porco; Matthew T. Hespos

(57) ABSTRACT

An automated teller machine (10) has at least one receiving compartment (12 to 18) for receiving a cash box (102). At least one locking element (24, 26) is provided on a wall (20, 22) of the receiving compartment (12 to 18) and is movable between a locked and an unlocked position. The locking element (24, 26) is designed and mounted such that, when a cash box (102) is inserted the locking element (24, 26), the locking element (24, 26) is moved automatically from the unlocked into the locked position by contact with an engagement element (104) of the cash box (102).

18 Claims, 3 Drawing Sheets

(51) Int. Cl.

| | |
|---|---|
| ***G07D 11/00*** | (2006.01) |
| ***G07F 9/06*** | (2006.01) |
| ***G07F 19/00*** | (2006.01) |
| ***G07F 17/12*** | (2006.01) |
| ***A47B 88/467*** | (2017.01) |

(52) U.S. Cl.
CPC ..... *G07F 9/06* (2013.01); *G07F 17/12* (2013.01); *G07F 19/20* (2013.01); *G07F 19/205* (2013.01)

(58) Field of Classification Search
CPC ..... E05B 65/461; G07D 11/0006; G07F 9/06; G07F 9/10; G07F 19/20; G07F 19/201; G07F 19/205
See application file for complete search history.

(56) References Cited

U.S. PATENT DOCUMENTS

| | | | |
|---|---|---|---|
| 2002/0007771 | A1 | 1/2002 | Braddock |
| 2002/0063035 | A1 | 5/2002 | Blad et al. |

FOREIGN PATENT DOCUMENTS

| | | | |
|---|---|---|---|
| GB | 1175151 B | * | 12/1969 |
| WO | 2013/052348 | | 4/2013 |

* cited by examiner

AUTOMATED TELLER MACHINE WITH AN AUTOMATICALLY ACTUATABLE LOCKING ELEMENT FOR LOCKING CASH BOXES RECEIVED IN RECEIVING COMPARTMENTS IN THESE RECEIVING COMPARTMENTS

BACKGROUND

1. Field of the Invention

The invention relates to an automated teller machine having at least one receiving compartment for receiving a cash box.

2. Description of the Related Art

Known automated teller machines have several receiving compartments, into each of which a cash box can be inserted and again be removed therefrom. For the automatic feeding of notes of value to the cash box or the automatic removal of notes of value from the cash box it is necessary that the cash box is arranged in a precisely predetermined position within the receiving compartment. In order to ensure this, most automated teller machines have locking mechanisms by means of which the cash box is held in the predetermined position in the receiving compartment.

In the known locking mechanisms, a locking element for locking and/or unlocking the cash box has to be actuated manually. This has the disadvantage that, when a cash box is removed, one hand is required for unlocking so that the cash box can only be handled with one hand, which makes the handling more difficult. In addition, such locking mechanisms are complexly constructed and thus also cost-intensive.

US 2002/0007771 A1 discloses an automated teller machine in which one retainer each is mounted in front of the cash boxes to prevent their removal. These retainers are attached and removed manually.

U.S. Pat. No. 6,047,998 A describes a mechanism by means of which cash boxes can be locked within an automated teller machine. Here, too, the locking has to be performed actively and is very complexly constructed.

US 2002/0063035 A1 describes a cart for the transport of cash boxes, in which the cash boxes are locked in their receiving compartments via a locking mechanism.

It is the object of the invention to specify an automated teller machine in which the locking and unlocking of the cash boxes in the receiving compartment is accomplished particularly easily and that is constructed simply and cost-efficiently.

SUMMARY

According to the invention, at least one locking element which is movable between a locked and an unlocked position is provided on a wall of the receiving compartment. Here, the locking element is designed and mounted to the wall such that when a cash box is inserted into the receiving compartment the locking element is moved automatically from the unlocked into the locked position by means of a contact with an engagement element of the cash box.

The locking element may be designed and mounted such that when the cash box is removed from the receiving compartment the locking element is moved automatically from the locked position into the unlocked position by means of the contact with the engagement element of the cash box.

Since the locking and unlocking of the locking mechanism is accomplished automatically by means of the contact with the cash box when the cash box is inserted or removed, it is no longer necessary that a locking mechanism has to be locked or unlocked manually. Thus, a particularly easy handling is possible since the operator can use both hands for the insertion or removal of the cash box. In addition, elements that require a manual operation can be dispensed with so that the locking element and the entire locking mechanism can be constructed particularly easily and thus cost-efficiently. Nevertheless, by means of the automatic locking it is guaranteed that the cash box, when inserted into the receiving compartment, is always arranged in the predetermined position.

Since the locking mechanism in particular merely serves to guarantee that the cash box is arranged in the predetermined position and does not serve as an anti-removal protection for preventing the unauthorized removal, it is not necessary that the locking mechanism has to be activated actively. Rather, the passive activation via the cash box is sufficient and makes the correspondingly simple structure and the easy handling possible.

The locking element may be designed such that when a cash box has been inserted into the receiving compartment and the locking element is arranged in the locked position, the engagement element of the cash box is received in a receiving area of the locking element such that the cash box cannot be removed from the receiving compartment without the locking element being moved from the locked into the unlocked position during removal.

On the contrary, the unlocked position is the position of the locking element in which the cash box can be removed without the locking element first having to be changed with respect to its position and in particular without the cash box contacting the locking element at all.

The locking element may be mounted to the wall of the receiving compartment rotatably about an axis of rotation. The locking element may be pivoted about this axis of rotation between the locked and the unlocked position by a predetermined angle. Thus, a particularly easy movement of the locking element between the locked and the unlocked position is achieved. In particular, due to this pivot movement only little installation space is required and the entire mechanism can have a simple design.

Further, an elastic element may be provided which biases the locking element to the locked position when it is arranged in the locked position, and which biases the locking element to the unlocked position when it is arranged in the unlocked position. As a result, it is achieved that the locking element is always biased in its respective position and has to be moved against the restoring force of the elastic element from the respective one position into the respective other position by means of the contact with the engagement element.

The elastic element may be designed as a spring, such as a screw tension spring. A first end of the spring may be mounted to the wall of the receiving compartment and a second end of the spring may be mounted to the locking element. Thus, a particularly simple, cost-efficient structure is achieved.

A circular ring segment-shaped guide slot may be provided in the wall of the receiving compartment and the locking element may have a projection, in particular a boss, that projects into the guide slot so that the locking element, when moved between the locked and the unlocked position, is guided via the engagement of the projection in the guide slot.

Thus, a safe movement of the locking element between the unlocked and the locked position is achieved. In particular, it is guaranteed via the guide slot that, despite of the biasing by means of the elastic element, the locking element can only move between the locked and the unlocked position and an unintentional movement into a non-defined position is prevented.

When the locking element is arranged in the unlocked position, then the projection of the locking element may be arranged at a first end of the guide slot and may contact a wall of the guide slot that delimits the guide slot in this direction. On the contrary, the projection may be arranged at a second end of the guide slot when the locking element is arranged in the locked position and, here too, may contact a wall delimiting the guide slot.

As a result, on the one hand, the definition of the locked and the unlocked position is achieved easily. On the other hand, the knocking of the projection against the end of the respective guide slot produces a sound, in particular a clicking sound, by which the operator who inserts or removes the cash box is informed acoustically that the locking mechanism is released or actuated.

The elastic element is arranged such that when the projection is arranged towards the first end with respect to the peak of the guide slot, i.e. has a smaller angular distance to the first end than to the second end, the elastic element moves the locking element into the unlocked position. When the projection is arranged towards the second end with respect to the peak of the guide slot, i.e. has a smaller angular distance to the second end than to the first end, the elastic element moves the locking element into the locked position. The peak of the guide slot is in particular defined as the point that has the same distance to both ends of the guide slot and has the largest distance to the mounting point of the elastic element via which the elastic element is mounted to the wall.

As a result, it is easily achieved that the locking element always has to be moved against the force of the elastic element from one position into the other position and is biased by the elastic element into its former position until the peak is passed.

The peak of the guide slot and the mounting point where the elastic element is mounted to the wall may lie on a straight line that intersects the axis of rotation about which the locking element is rotatable. In particular, the axis of rotation, the peak and the mounting point may be arranged vertically below one another.

As a result, it is achieved that the elastic element, when the projection of the locking element is arranged at the peak, i.e. when the locking element is arranged exactly centrally between the unlocked and the locked position, exerts the highest restoring force onto the locking element and thus, when the locking element is moved out of the central position, always moves the locking element in the direction in which it has been moved from the center.

The locking element may be designed in a Y-shaped manner. Here, the locking element in particular has a first leg, a second leg and a third leg that are connected to each other by one common connecting area, and the axis of rotation about which the locking element can be rotated may run through the point of intersection of the three legs, in particular the point of intersection of the longitudinal centerline of the legs. Thus, a particularly simple and compact structure is achieved.

The projection that is guided in the guide slot may be provided at the end of the first leg opposite to the point of intersection. In particular, also the elastic element is mounted to the locking element at this end of the first leg opposite to this point of intersection.

Between the second and the third leg, on the other hand, the receiving area may be provided in which the engagement element of the cash box may be arranged when the cash box is inserted into the receiving compartment.

In particular, the engagement element of the cash box presses against the second leg when the cash box is inserted and moves the locking element from the unlocked into the locked position by means of this contact. When, on the other hand, the cash box is removed, the engagement element contacts the third leg of the locking element and moves the locking element from the locked into the unlocked position by means of this contact. As a result, a particularly simple structure and a particularly simple but nevertheless safe functionality is achieved.

A further locking element may be arranged on the wall of the receiving compartment. The further locking element may be designed and mounted such that when the cash box is inserted into the receiving compartment the further locking element is moved automatically from the unlocked into the locked position by means of the contact with a further engagement element of the cash box and/or when the cash box is removed from the receiving compartment the further locking element is moved automatically from the locked into the unlocked position by means of the contact with the further engagement element.

The two locking elements may be arranged at opposite sides of the receiving compartment.

The further locking element may be formed identically to the afore-described locking element. In particular, the mounting of the further locking element also may be designed analogously to the mounting of the one locking element. In particular, the further locking element and the entire mechanism of the further locking element can be developed with the features described above for the one locking element.

Further, the automated teller machine may comprise at least one further receiving compartment, preferably several further receiving compartments.

In these receiving compartments, too, in particular one, preferably two locking elements each are arranged. The locking elements may be designed and mounted identically to the afore-mentioned locking elements. As a result, it is achieved that in all receiving compartments of the automated teller machine a safe and simple locking of the cash boxes can be accomplished.

A further aspect of the invention relates to an arrangement comprised of an automated teller machine of the afore-described type and a cash box, the cash box being received in the receiving compartment of the automated teller machine.

Further features and advantages of the invention result from the following description which describes the invention in more detail on the basis of embodiments in connection with the enclosed Figures.

DETAILED DESCRIPTION

Figure 1:
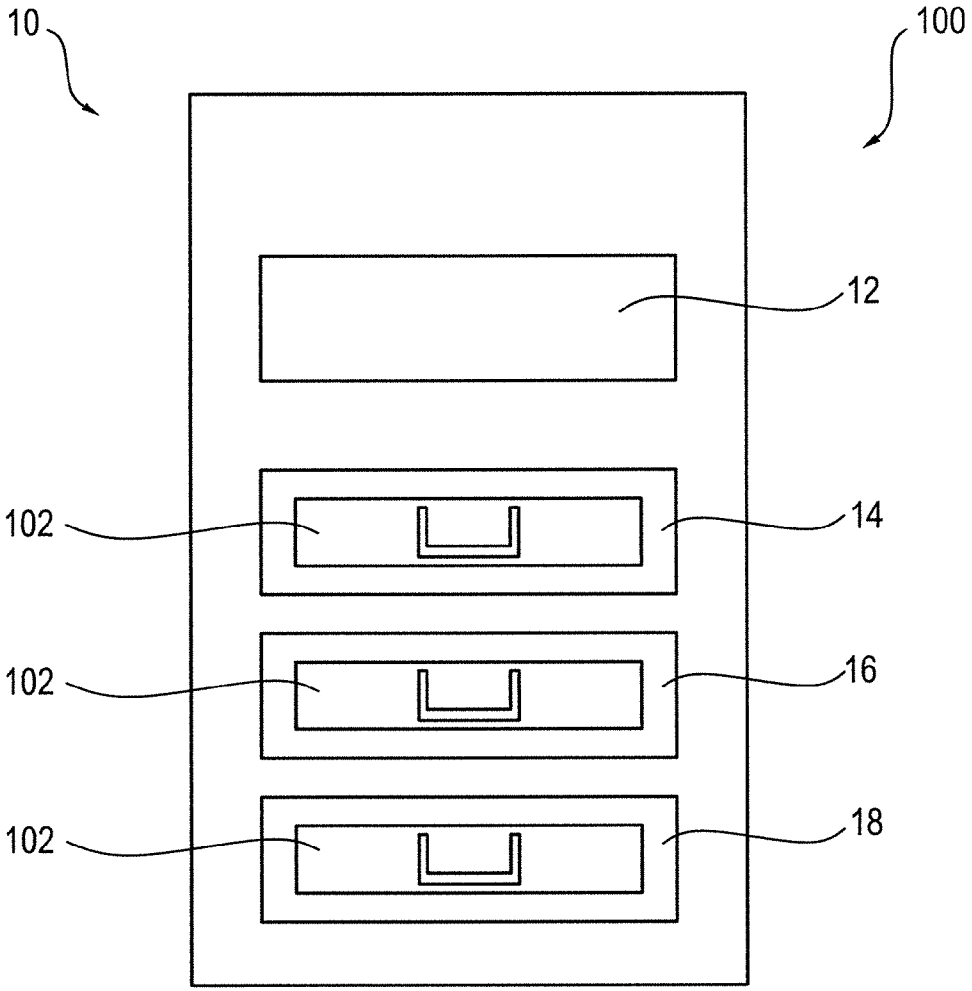
FIG. 1 shows a schematic highly simplified illustration of an automated teller machine and three cash boxes.

In FIG. 1, a schematic highly simplified illustration of an arrangement 100 comprised of an automated teller machine 10 and three cash boxes 102 is shown. The automated teller machine 10 has four receiving compartments 12 to 18, wherein one cash box 102 each is inserted into the receiving compartments 14 to 18 and no cash box is inserted into the receiving compartment 12.

The cash boxes 102 can be removed from the receiving compartments 12 to 18 and inserted therein. For the orderly feeding of notes of value to the cash boxes 102 and the orderly removal of notes of value from the cash boxes 102 it is necessary that these are arranged in predetermined positions within the automated teller machine.

Figure 2:
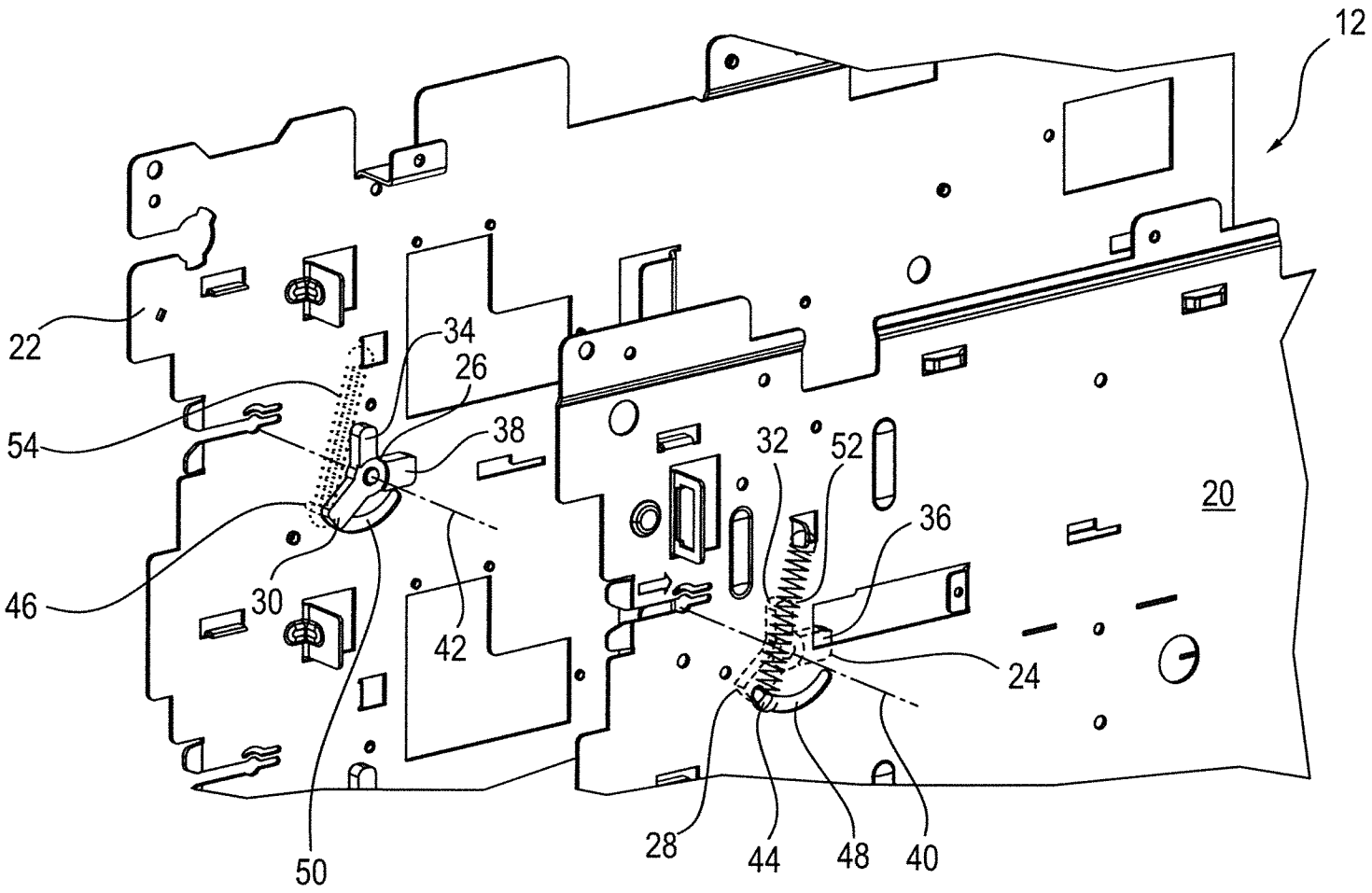
FIG. 2 shows a schematic perspective illustration of a detail of a receiving compartment of the automated teller machine according to FIG. 1.
Figure 3:
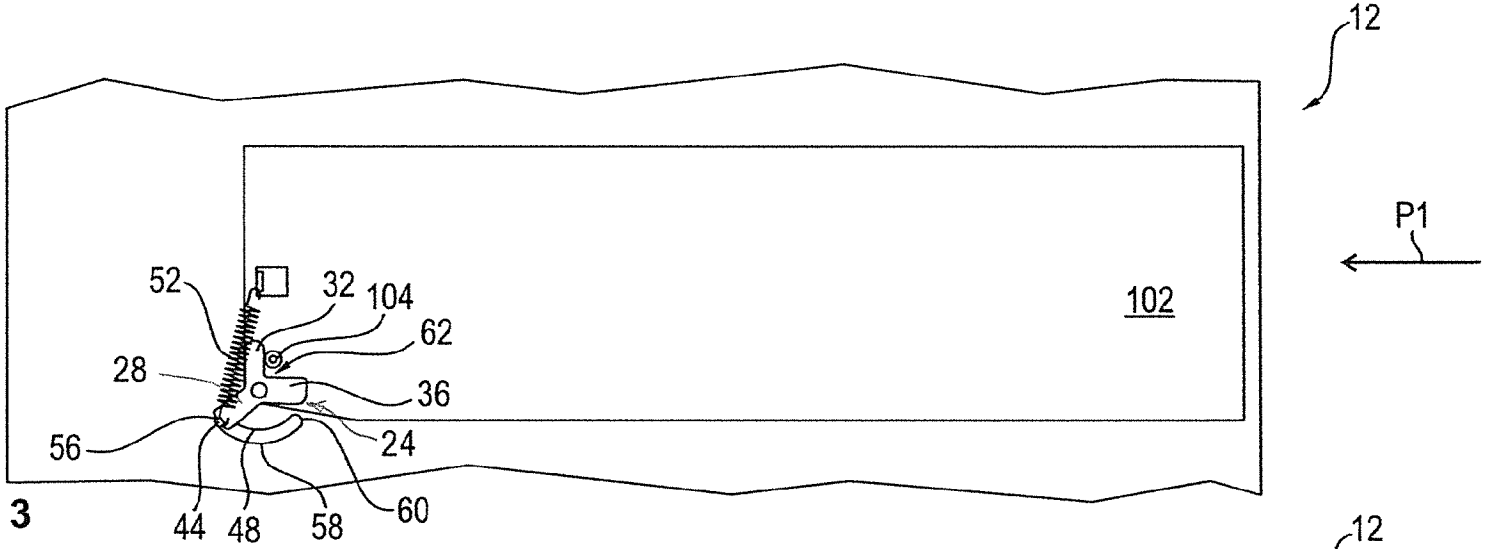
FIG. 3 shows a schematic perspective illustration of the receiving compartment according to FIG. 2 and a cash box in a first operating state.
Figure 4:
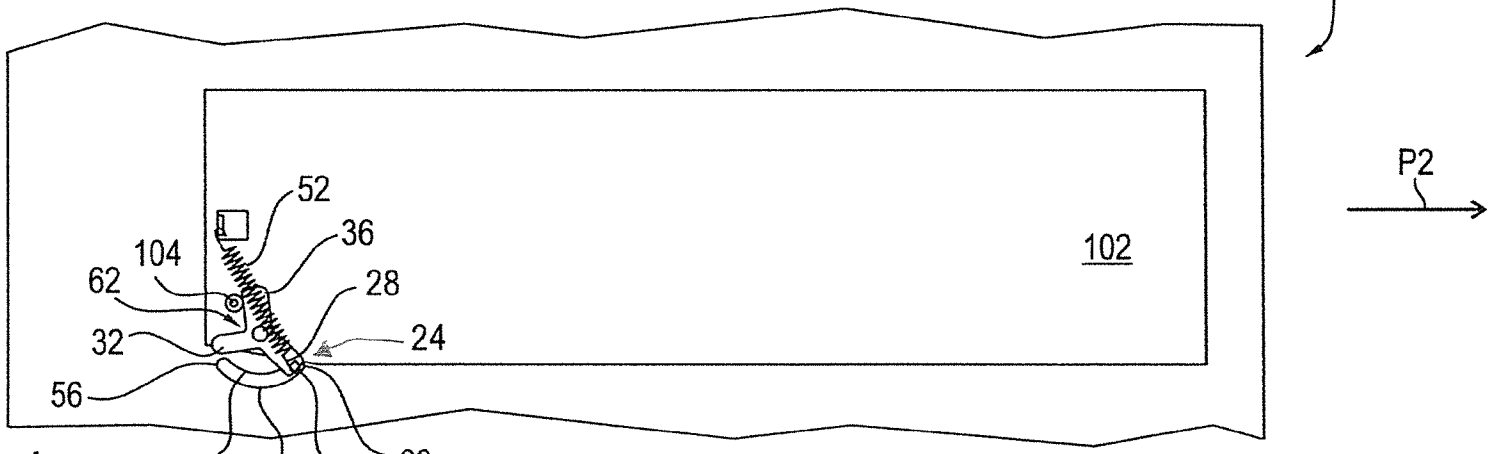
FIG. 4 shows a schematic illustration of the receiving compartment and the cash box according to FIG. 3 in a second operating state.

In order to guarantee this predetermined orientation, a locking mechanism described in more detail in connection with FIGS. 2 to 4 is provided in each receiving compartment 12 to 18. This locking mechanism is exemplarily described for the receiving compartment 12. The other receiving compartments 14 to 18 are in particular identically formed and in particular have the same locking mechanism.

In FIG. 2, a schematic perspective illustration of a detail of the receiving compartment 12 is shown. The receiving compartment 12 has a first side wall 20 and a second side wall 22. At the sides of the side walls 20, 22 which face the receiving area in which the cash box 102 is received one locking element 24, 26 each is arranged. The locking elements 24, 26 are designed in a Y-shaped manner and each have a first leg 28, 30, a second leg 32, 34 as well as a third leg 36, 38.

The locking elements 24, 26 each are mounted to the side walls 20, 22 rotatably about an axis of rotation 40, 42, the axis of rotation 40, 42 running through the point of intersection of the center axes of the legs 28 to 38.

At the end of the first leg 28, 30 opposite to the axis of rotation 40, 42, one projection 44, 46 each is provided which is guided in a circular ring segment-shaped guide slot 48, 50 of the respective side wall 20, 22.

Further, a respective first end of a spring 52, 54 is arranged at the projection 44, 46, the respective second end of the respective spring 52, 54 being mounted to the respective side wall 20, 22.

When no cash box 102 is received in the receiving compartment 12, then the locking elements 24, 26 are arranged in an unlocked position shown in FIG. 3. In this unlocked position, the projections 44, 46 are arranged at a first end 56 of the respective guide slot 48, 50.

When, as shown in FIG. 3, a cash box 102 is inserted into the receiving compartment 12 in the direction of the arrow P1, then engagement elements 104, which are designed in the form of small pins, contact the second legs 32, 34 of the respective locking elements 24, 26. By means of the contact between the engagement elements 104 and the second legs 32, 34, the locking elements 24, 26 are moved against the restoring force of the springs 52, 54 from the unlocked position into a locked position shown in FIG. 4. Here, the springs 52, 54 are tensioned further until the projections 44, 46 are arranged at the peaks 58 of the guide slots 48, 50. When the peak 58 is passed, then the spring 52, 54, which is now under maximum tension, pulls the respective locking element 24, 26 into the locked position in which the projections 44, 46 are arranged at the second ends 60 of the guide slots 48, 50 opposite to the first ends 56.

When the locking units 24, 26 are arranged in the locked position, as shown in FIG. 4, then the engagement elements 104 of the cash box 102 are received in the receiving areas 62 arranged between the second legs 32, 34 and the third legs 36, 38 so that the cash box 102 is held in a predetermined position.

When the cash box 102 is removed, it is moved in the direction of the arrow P2 out of the receiving area, wherein the engagement elements 104 contact the third legs 36, 38 of the locking elements 24, 26 and by means of this contact again move the locking elements 24, 26 automatically from the locked position back into the unlocked position.

The above-described locking mechanism has the advantage that the locking and unlocking is automatically performed during insertion and removal of the cash box 102. Further, the locking mechanism has the advantage that it is constructed very simply and cost-efficiently. In addition, by way of the knocking of the projections 44, 46 against the ends 56, 60 of the guide slots 48, 50 characteristic clicking sounds occur by which the operator can hear the locking and the unlocking.

LIST OF REFERENCE SIGNS

10 automated teller machine
12 to 18 receiving compartment
20, 22 side wall
24, 26 locking element
28 to 38 leg
40, 42 axis of rotation
44, 46 projection
48, 50 guide slot
52, 54 spring
56, 60 end
58 peak
62 receiving area
100 arrangement
102 cash box
104 engagement element
P1, P2 direction

What is claimed is:

1. An automated teller machine, comprising:

at least one receiving compartment (12 to 18) for receiving a cash box (102), the receiving compartment (12 to 18) having a wall (20, 22);

at least one locking element (24, 26) having a first leg (28, 30), a second leg (32, 34) and a third leg (36, 38) and being provided on the wall (20, 22) of the receiving compartment (12 to 18) for rotation about an area of intersection of these three legs (28 to 38), the locking element (24, 26) being rotatable between a locked and an unlocked position, the locking element (24, 26) being designed and mounted such that when a cash box (102) is inserted into the receiving compartment (12 to 18), the locking element (24, 26) being moved automatically from the unlocked position into the locked position by means of contact of an engagement element (104) of the cash box (102) with the second leg (32, 34) and being moved from the locked position into the unlocked position by means of contact of the engagement element (104) of the cash box (102) with the third leg (36, 38); and an elastic element (52, 54) having a first end mounted to the wall (20, 22) and a second end mounted to the first leg (28, 30) of the locking element (24, 26) at a position remote from the area of intersection of the three legs (28 to 38), the elastic element (52, 54) biasing the locking element (24, 26) to the locked position when the locking element (24, 26) is in the locked position and biasing the locking element (24, 26) to the unlocked position when the locking element (24, 26) is in the unlocked position.

2. The automated teller machine (10) of claim 1, wherein the locking element (24, 26) is configured such that when a cash box (102) is inserted into the receiving compartment (12 to 18), the engagement element (24, 26) is received in a receiving area (62) between the second leg (32, 34) and the third leg (36, 38) of the locking element (24, 26) with the locking element (24, 26) being in the locked position such that the cash box (102) cannot be removed from the receiving compartment (12 to 18) without moving the locking element (24, 26) from the locked into the unlocked position during the removal.

3. The automated teller machine (10) of claim 2, wherein the first and second ends of the elastic element (52, 54) are on opposite respective sides of the receiving area of the locking element (24, 26).

4. The automated teller machine (10) of claim 1, wherein the elastic element (52, 54) comprises a spring.

5. The automated teller machine (10) of claim 1, further comprising a circular ring segment-shaped guide slot (48, 50) provided in the wall (20, 22), and the first leg (28, 30) of the locking element (24, 26) comprising a projection (44, 46) that is guided in the guide slot (48, 50) and the engagement of the projection (44, 46) in the guide slot (48, 50) guides the locking element (24, 26) during the movement between the locked and the unlocked position.

6. The automated teller machine (10) of claim 5, wherein when the locking element (24, 26) is in the unlocked position, the projection (44, 46) is arranged at a first end (56) of the guide slot (48, 50) and when the locking element (24, 26) is in the locked position, the projection (44, 46) is arranged at a second end (60) of the guide slot (48, 50).

7. The automated teller machine (10) of claim 6, wherein the guide slot (48, 50) further has a peak (58) disposed centrally between the first and second ends (56, 60), the elastic element (52, 54) being arranged such that when the projection (44, 46) is arranged towards the first end (56) with respect to the peak (58) of the guide slot (48, 50) the elastic element (52, 54) moves the locking element (24, 26) into the unlocked position, and when the projection (44, 46) is arranged towards the second end (60) with respect to the peak (58) of the guide slot (48,50), the elastic element (52, 54) moves the locking element (24, 26) into the locked position.

8. The automated teller machine (10) of claim 6, wherein the peak (58) of the guide slot (48, 50) and the mounting point at which the elastic element (48, 50) is mounted to the wall (20, 22) lie on a straight line and that the axis of rotation (40, 42) about which the locking element (24, 26) is rotatable intersects this straight line.

9. The automated teller machine (10) of claim 1, wherein the locking element (24, 26) is Y-shaped.

10. The automated teller machine (10) of claim 1, wherein the wall (20, 22) of the receiving compartment (12 to 18) has a further locking element (24, 26) and the further locking element (24, 26) being designed and mounted such that, when a cash box (102) is inserted into the receiving compartment (12 to 18), the further locking element (24, 26) is moved from the unlocked position into the locked position by means of contact with a further engagement element (104) of the cash box (102).

11. The automated teller machine (10) of claim 10, wherein the two locking elements (24, 26) are formed identically.

12. An arrangement (100), comprising:

the automated teller machine (10) of claim 1, and a cash box (102) received in the receiving compartment (12 to 18) of the automated teller machine (10).

13. An automated teller machine, comprising:

at least one receiving compartment (12 to 18) for receiving a cash box (102), the receiving compartment (12 to 18) having a wall (20, 22), a circular ring segment-shaped guide slot (48, 50) provided in the wall (20, 22), the guide slot (48, 50) having a first end (56), a second end (60) and a peak (58) centrally between the first and second ends (56, 60);

at least one locking element (24, 26) provided on the wall (20, 22) of the receiving compartment (12 to 18), the locking element (24, 26) being rotatable between a locked position and an unlocked position, the locking element (24, 26) comprising a projection (44, 46) that is guided in the guide slot (48, 50), the projection (44, 46) being at the first end (56) of the guide slot (48, 50) when the locking element (24, 26) is in the unlocked position, and being at the second end (60) of the guide slot (48, 50) when the locking element (24, 26) is in the locked position, the locking element (24, 26) being configured and mounted so that an engagement element (104) of the cash box (102) contacts the locking element (24, 26) when the cash box (102) is inserted into or removed from the receiving compartment (12 to 18) for moving the locking element (24, 26) between the unlocked position and the locked position; and an elastic element (52, 54) having a first end mounted to the wall (20, 22) and a second end mounted to a portion of the locking element (24, 26) in proximity to the projection (44, 46), the elastic element (52, 54) biasing the locking element (24, 26) to the locked position when the locking element (24, 26) is in the locked position and biasing the locking element (24, 26) to the unlocked position when the locking element (24, 26) is in the unlocked position, the peak (58) of the guide slot (48, 50) and a mounting point at which the elastic element (48, 50) is mounted to the wall (20, 22) lie on a straight line and the axis of rotation (40, 42) about which the locking element (24, 26) is rotatable intersecting this straight line.

14. The automated teller machine (10) of claim 13, wherein the locking element (24, 26) comprises a first leg (28, 30), a second leg (32, 34) and a third leg (36, 38), and the locking element (24, 26) is mounted to the wall (20, 22) rotatably about an area of intersection of these three legs (28 to 38).

15. The automated teller machine (10) of claim 14, wherein the projection (44, 46) that is guided in the guide slot (48, 50) is provided at the end of the first leg (28, 30) opposite to the area of intersection, and/or that the elastic element (52, 54) is mounted to the first leg (28, 30) at the end thereof that is opposite to the area of intersection.

16. The automated teller machine (10) of claim 14, wherein the receiving area (62) in which the engagement element (104) of the cash box (102) is received when the cash box (102) is inserted into the receiving compartment (12 to 18) is arranged between the second and the third leg (32 to 38).

17. The automated teller machine (10) of claim 13, wherein the circular ring segment-shaped guide slot (48, 50) has a concave side facing toward the engagement element (104) of the cash box (102) when the engagement element (104) of the cash box (102) is between the second and third legs (32-38) of the locking element (24, 26).

18. The automated teller machine (10) of claim 13, wherein the first and second ends of the elastic element (52, 54) are on opposite respective sides of the areas of the locking element (24, 26) that are contacted by the engagement element (104) of the cash box (102).

* * * * *